US007401780B2

(12) United States Patent
Carter et al.

(10) Patent No.: US 7,401,780 B2
(45) Date of Patent: Jul. 22, 2008

(54) ROLLER WITH RECESSED KICKER FEATURE

(75) Inventors: Daniel L. Carter, Georgetown, KY (US); Phill Douglas Cole, Richmond, KY (US); Edward Lawrence Kiely, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 393 days.

(21) Appl. No.: 10/949,263

(22) Filed: Sep. 24, 2004

(65) Prior Publication Data

US 2006/0157922 A1 Jul. 20, 2006

(51) Int. Cl.
*B65H 5/02* (2006.01)

(52) U.S. Cl. ..... 271/272; 271/109; 492/30

(58) Field of Classification Search ..... 271/109, 271/119, 272, 273, 274; 492/28, 30, 48
See application file for complete search history.

(56) References Cited

U.S. PATENT DOCUMENTS 2,694,570 A * 11/1954 De Lano ..... 271/306
4,251,067 A * 2/1981 Mitzel ..... 271/196
4,861,013 A * 8/1989 Shibata et al. ..... 271/119
5,277,416 A * 1/1994 Kim ..... 271/119
5,529,211 A * 6/1996 Ishiwata ..... 271/274
6,089,567 A * 7/2000 Yatsuhashi et al. ..... 271/314
7,170,658 B2 * 1/2007 Shirai et al. ..... 358/496
2007/0064076 A1 * 3/2007 Carter et al. ..... 347/101

FOREIGN PATENT DOCUMENTS

JP 63008157 A * 1/1988
JP 02043161 A * 2/1990
JP 2003246537 A * 9/2003
JP 2006213452 A * 8/2006

* cited by examiner

*Primary Examiner*—Patrick Mackey
*Assistant Examiner*—Michael C McCullough
(74) *Attorney, Agent, or Firm*—Coats & Bennett, PLLC

(57) ABSTRACT

A method and apparatus for moving media through an image forming device using a roller having a recessed kick area is described herein. The roller includes a contact surface having a first radius that extends 360° around the roller. The roller also includes at least one recess that extends inwardly from the contact surface along a sector of the roller, where a bottom surface of the recess has a second radius less than the first radius. As a result, along the sector of the roller having the recess, the width of the contact surface is less than the width of the roller. The recess comprises at least one kick surface on one end of the recess. As the roller rotates, the kick surface kicks a trailing edge of media exiting the exit roller system into a desired bin of the image forming device.

18 Claims, 5 Drawing Sheets

ROLLER WITH RECESSED KICKER FEATURE

BACKGROUND

The present invention relates generally to image forming devices and more particularly to rollers that move media through image forming devices.

Printers, copiers, and other image forming devices include a variety of rollers/roller systems and transport belts to move media. Rollers/roller systems and transport belts move the media through the device, from initially grabbing the media from an input tray, moving the media past image forming units to apply loose toner to the media, fusing the loose toner to the media sheet, and outputting the media to an output tray of the image forming device.

Some exit roller systems include drive rollers that form a media-moving nip with idler rollers. When the drive rollers rotate, they cause the idler rollers to rotate in an opposite direction. As a result, media inserted between the drive rollers and the idler rollers moves through the exit roller system and into the output tray.

Typically, exit roller systems that employ drive and idler rollers include media kickers to prevent a trailing edge of the media from getting caught on a back edge of the output tray by kicking the trailing edge of the media down into the output tray. Some media kickers operate independently of the rollers of the exit roller system to kick the edge of the media into the output tray. Alternatively, some media kickers protrude from the idler roller to operate with the exit roller system to kick the edge of the media into the output tray.

SUMMARY

The present invention comprises a roller for moving media through an image forming device. One exemplary roller according to the present invention comprises a contact surface and at least one recess. The contact surface has a first radius that extends around the circumference of the roller. The recess extends inwardly along a sector of the roller, where a bottom surface of the recess has a second radius less than the first radius.

Another exemplary roller according to the present invention comprises a contact surface, a kick section, a recess, and a kick surface. The contact surface has a radius that extends 360 degrees around the roller. The portion of the roller where the width of the contact surface is less than the width of the roller defines a kick section. The recess extends inwardly from the contact surface along the kick section, and includes the kick surface disposed on one end, where the kick surface extends from the contact surface to a bottom surface of the recess.

Some embodiments of the present invention include more than one kick surface. For example, one embodiment of the present invention includes a first kick surface positioned at a first angular position and a second kick surface positioned at a second angular position along the roller circumference. The first kick surface extends inwardly from the contact surface such that a width of the contact surface adjacent the first kick surface is less than the width of the roller. Similarly, the second kick surface extends inwardly from the contact surface such that a width of the contact surface adjacent the second kick surface is less than the width of the roller. In one embodiment, the first and second kick surfaces are disposed on opposite ends of a single kick section, where the opposing ends of the kick section are defined by the first and second angular positions. In another embodiment, the roller includes first and second kick sections separated along the roller circumference by 180 degrees. In this embodiment, the first angular position defines one end of the first kick section and the second angular position defines one end of the second kick section, wherein the ends of the first and second kick sections face opposite directions.

In another embodiment, the contact surface extends around the roller circumference, where the contact surface has a first width less than the roller width in a kick section of the roller. A first kick section extending inwardly from the contact surface along the kick section has a second width less than the roller width, where the sum of the first and second widths is less than or equal to the roller width.

One exemplary roller system of the present invention comprises a first roller and a second roller. The first roller comprises a contact surface and at least one recess, where the contact surface has a first radius that extends around the circumference of the roller. The recess extends inwardly along a sector of the roller, where a bottom surface of the recess has a second radius less than the first radius. The second roller has an outer diameter that forms a media-moving nip with the contact surface of the first roller. In one embodiment, the first roller is an idler roller while the second roller is a drive roller. In another embodiment, the first roller is a drive roller while the second roller is an idler roller.

One exemplary method of moving media through an image forming device and into a desired bin according to the present invention comprises driving a first roller to move media along a contact surface of the first roller. A recessed kick area disposed on the first roller kicks the media into the desired bin by contacting a trailing edge of the media.

DETAILED DESCRIPTION

The present invention is directed towards roller systems in image forming devices. As used herein, an image forming device or apparatus may be any device that transfers an image onto media fed through the device. Such devices include, but are not limited to, printers, copiers, and facsimile machines. Examples of image forming devices include laser printer Model Nos. C750 and C752, both available from Lexmark International, Inc. of Lexington, Ky.

Figure 1:
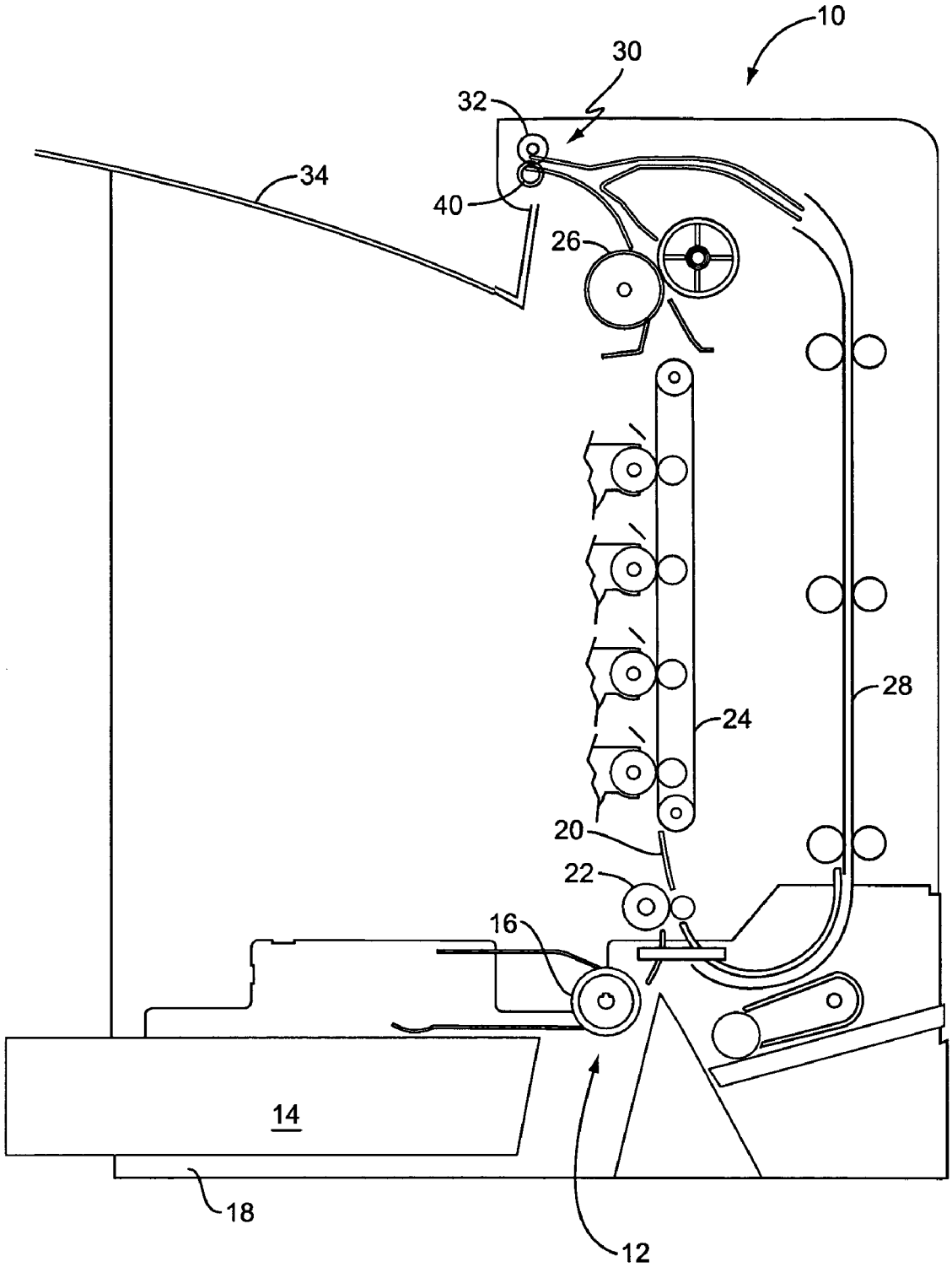
FIG. 1 is a schematic side view of an image forming device according to one embodiment of the present invention.

FIG. 1 depicts a schematic side view of one exemplary image forming device, such as a printer, indicated generally by the numeral 10. An input section of the main body 12 of image forming device 10 includes a media tray 14 with a pick mechanism 16 to introduce media disposed in the media tray 14 into the media path 20. The media tray 14 fits within an input cavity 18 of the image forming device 10 and may be removable for refilling. Alternatively, a multi-purpose feeder provides for inputting media. Those skilled in the art will appreciate that media tray 14 and multi-purpose feeder may be located in different sections of the image forming device 10 other than the lower section of the image forming device 10 shown in FIG. 1.

Media is fed into the media path 20 using one or more registration rollers 22 disposed along the media path 20 to align the media and precisely control its further movement. A media transport belt 24 moves the media past a plurality of image forming units (not shown) to form an image on the media. As the media moves past the image forming units, an imaging device (not shown) forms an electrical charge on a photoconductive member within the image forming units. Loose toner particles are attracted to the photoconductive member, and then transferred to the media as part of the image formation process, as is well understood in the art. The media with loose toner is then moved through a fuser 26 that adheres the toner to the media. Exit roller system 30 rotates rollers 32, 40 to move the media to a desired bin or tray, such as an output tray 34, or to invert and move the media into a duplex path 28. Duplex path 28 directs the inverted media back through the image formation process to form an image on a second side of the media, or a second image on the first side.

Figure 2:
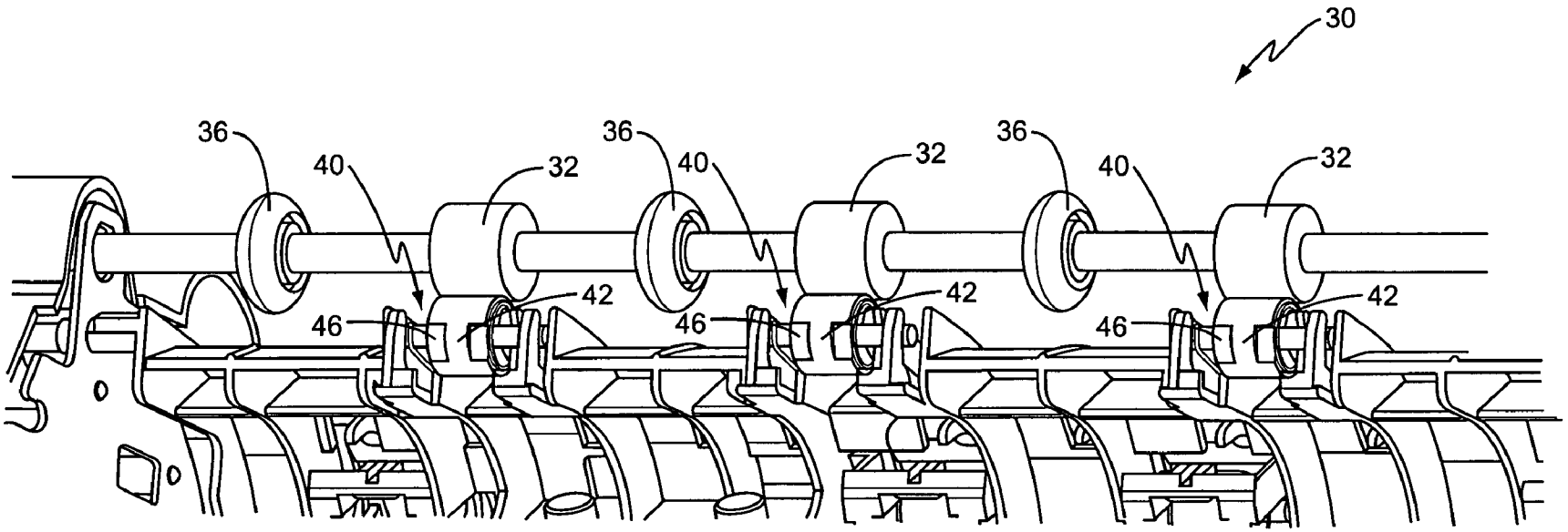
FIG. 2 is a fragmentary perspective view of one embodiment of an exit roller system for the image forming device of FIG. 1.

FIG. 2 illustrates a fragmentary perspective view of one embodiment of exit roller system 30. Exit roller system 30 includes one or more corrugators 36 and one or more first rollers 32 disposed proximate one or more second rollers 40. As used herein, "first" and "second" simply describe the general positional relationship between rollers 32, 40. As shown in FIG. 2, each first roller 32 forms a media-moving nip with a contact surface 42 on a corresponding second roller 40. While FIG. 2 includes corrugators 36, it will be appreciated that such is not required by the present invention.

As understood by those skilled in the art, one roller in each roller pair 32, 40 operates as a drive roller, while the other roller operates as an idler roller. A drive motor operatively connected to the drive roller rotates the drive roller in a desired direction, which in turn rotates the idler roller in an opposite direction. In one exemplary embodiment, the first roller 32 is a drive roller that drives the second roller 40. Alternatively, those skilled in the art will appreciate that second roller 40 may operate as a drive roller that drives the first roller 32.

Exit roller systems 30 typically include a kick mechanism to force media exiting the exit roller system 30 into the desired bin. Conventional kick mechanisms are either separate from the rollers 32, 40, or protrude from one of the rollers 32, 40. However, as discussed further below with reference to FIGS. 3A-7, the second roller 40 of the present invention includes one or more kick sections 44 that comprise at least one recessed area 46, where each recessed area 46 has at least one kick surface 48 that extends inwardly from the outer surface of second roller 40. At least one of the kick surfaces 48 associated with one of the second rollers 40 kicks a trailing edge of the media into a desired location, such as an output tray 34 of the image forming device 10.

FIGS. 3A-7 illustrate various exemplary rollers 40 according to the present invention. In each embodiment, roller 40 comprises a contact surface 42 having a fixed radius extending 360° around the circumference of the roller 40. Roller 40 also includes at least one kick section 44 disposed along a sector of roller 40. As shown in FIGS. 3A-7, the width of contact surface 42 is less than the width of the roller 40 along the kick section 44 of the roller. However, even in the kick section 44, the contact surface 42 maintains the same radius that is maintained outside of the kick section 44. As a result, contact surface 42 maintains continuous contact with the media and/or the roller 32 when installed in the exit roller system 30 of the image forming device 10.

Figure 3A:
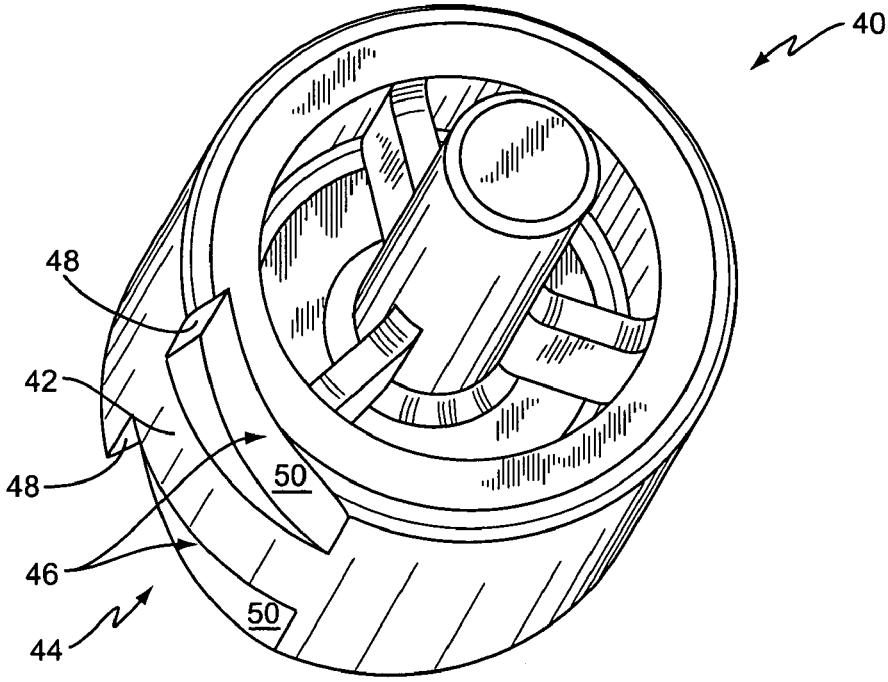
FIG. 3A is a perspective view of one exemplary roller according to one exemplary embodiment of the present invention.
Figure 4:
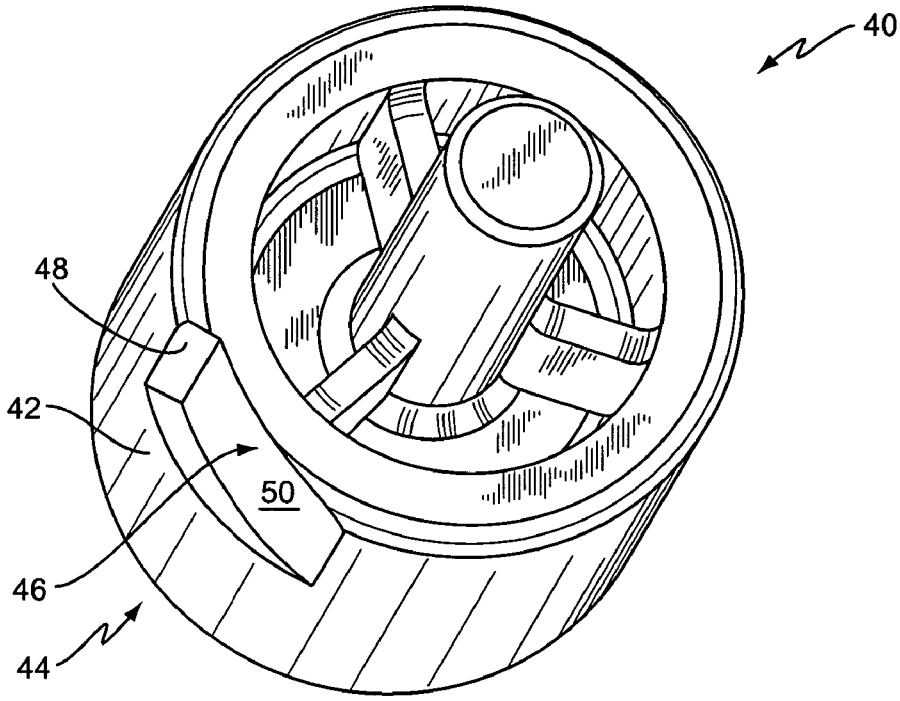
FIG. 4 is a perspective view of another exemplary roller according to one exemplary embodiment of the present invention.
Figure 5:
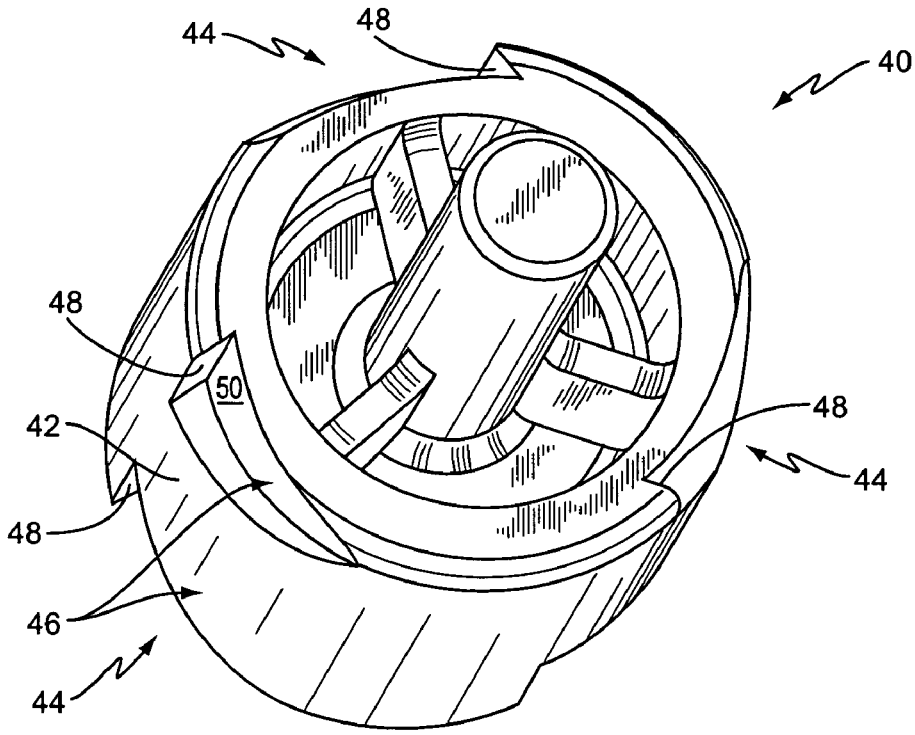
FIG. 5 is a perspective view of another exemplary roller according to one exemplary embodiment of the present invention.

As shown in FIGS. 3A, 4, 6, and 7, the outer edge of the contact surface 42 in the kick section 44 runs parallel to the outer side edge of the roller 40. However, the present invention is not so limited. For example, as shown in FIG. 5, the outer edge of the contact surface 42 may taper inwardly from the outer side edge of the roller 40 from one end of the kick section 44 to the other end.

Figure 3B:
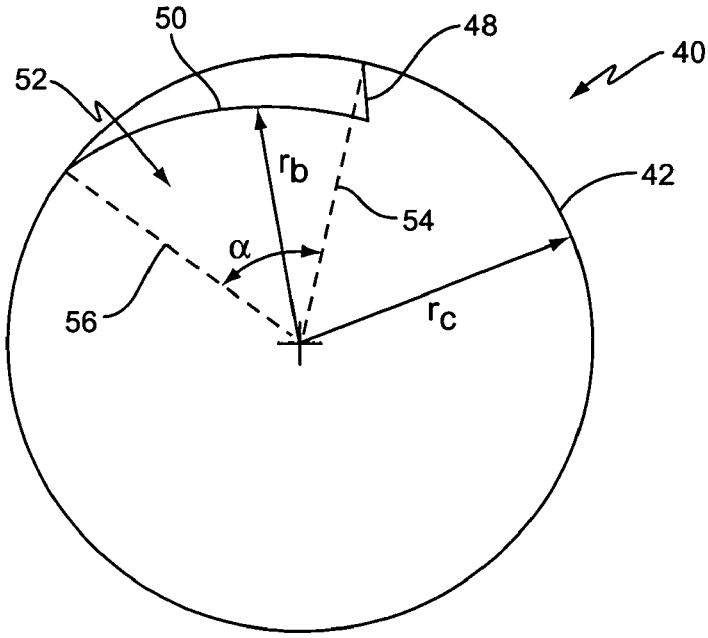
FIG. 3B is a cross-section view of the roller of FIG. 3A.

Each kick section 44 on roller 40 includes at least one recessed area 46 that extends inwardly from the contact surface 42. A cross-section of one exemplary recessed area 46 for the roller of FIG. 3A is shown in FIG. 3B. As shown in FIG. 3B, one angular position 54 along the circumference of the roller 40 defines one end of sector 52, while angular position 56, separated from angular position 54 by an angle □, defines the other end of sector 52. As such, the angular positions 54, 56 define the boundaries of kick section 44 by defining the boundaries of a sector 52. Because area 46 is recessed with respect to contact surface 42, a bottom surface 50 of recessed area 46 necessarily has a radius $r_b$ less than the radius $r_c$ of the contact surface 42. In this embodiment, radius $r_b$ declines in length from a maximum adjacent to position 56 to a minimum adjacent position 54.

Recessed area 46 provides at least one kick surface 48 that extends inwardly from contact surface 42 to bottom surface 50. The kick surface 48 contacts the trailing edge of the media and "kicks" it into the desired bin, such as the output tray 34. The kick surface 48 is angled relative to the contact surface 42 to contact the trailing edge of the media. The angle of the kick surface 48 may range between a sharper acute angle, best illustrated in FIGS. 5 and 6, to a wider obtuse angle as illustrated in FIG. 4. In exemplary embodiments, the angle of the kick surface 48 relative to the contact surface at the point of intersection may range between 30° and 150°. According to one exemplary embodiment, the angle is generally 90°, as shown in FIG. 3A.

One exemplary bottom roller 40 according to the present invention, shown in FIG. 3A, comprises one kick section 44, defined by an internal contact surface 42 flanked on both sides by recessed areas 46. While the embodiment of FIG. 3A illustrates that contact surface 42 is generally central to the width of roller 40, it will be appreciated that contact surface 42 may be positioned on any internal portion of the roller width. For example, while not explicitly shown, those skilled in the art will appreciate that kick section 44 may comprise two or more contact surfaces 42 positioned on internal portions of the roller width.

According to the embodiment shown in FIG. 3A, bottom surface 50 of each recessed area 46 tapers inwardly along the kick section 44 from the contact surface 42 to a bottom edge of a kick surface 48. As such, recessed area 46 forms a wedge-shaped notch along the outer edges of roller 40 such that the radius of the bottom surface 50 gradually increases from the kick surface 48 to the end of the recessed area 46 opposite the kick surface 48. As roller 40 rotates in a counter-clockwise direction, one or both kick surfaces 48 kicks the trailing edge of the media exiting rollers 32, 40 to move the media into a desired bin.

While FIG. 3A illustrates a roller 40 having a single kick section 44 with two recessed areas 46, those skilled in the art will appreciate that the present invention is not so limited. For example, as shown in FIG. 4, kick section 44 may comprise a single recessed area 46. In addition, roller 40 may comprise multiple kick sections 44 disposed around the circumference of the roller 40, as shown in FIG. 5, where each kick section 44 may include one or more recessed areas 46. While FIG. 5 only illustrates three kick sections 44, those skilled in the art will appreciate that roller 40 may include more than three kick sections 44. In any event, when roller 40 rotates in a counter-clockwise direction, one or more kick surfaces 48 kicks a trailing edge of the media exiting the media-moving nip formed by rollers 32, 40.

Further, while FIGS. 3A-5 illustrate a roller 40 having a kick surface 48 facing the counter-clockwise direction, those skilled in the art will appreciate that roller 40 may alternatively have a kick surface 48 facing the clockwise direction. As a result, when roller 40 rotates in a clockwise direction, kick surface 48 kicks a trailing edge of the media exiting rollers 32, 40 to move the media into the desired bin.

Figure 6:
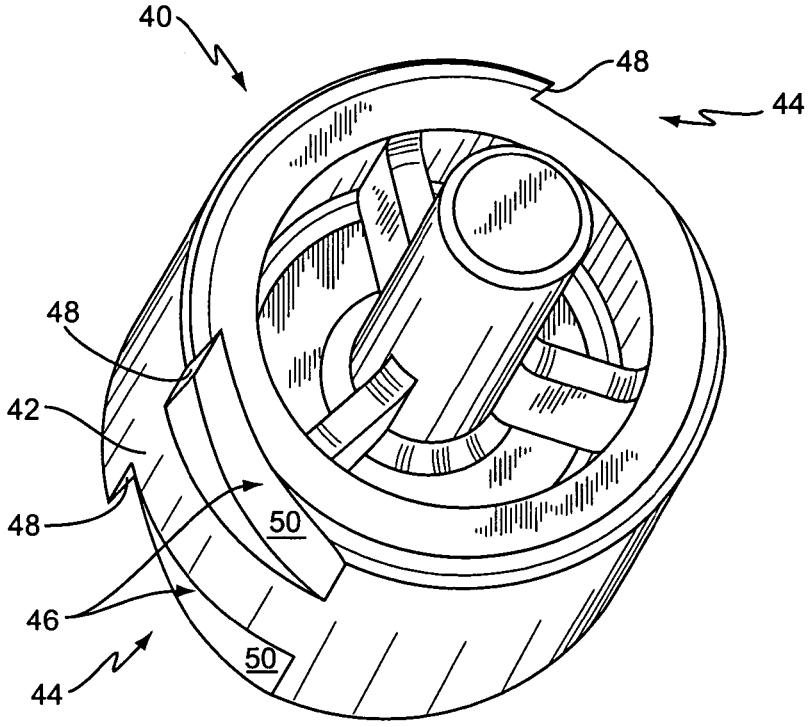
FIG. 6 is a perspective view of another exemplary roller according to one exemplary embodiment of the present invention.

To simplify installation of roller 40 into the exit roller system 30 of image forming device 10, roller 40 may include two kick surfaces 48 facing opposing directions. Therefore, regardless of which way the roller 40 is installed, and regardless of which direction the roller 40 rotates, a kick surface 48 is available to kick a trailing edge of the media to move the media into the desired bin. For example, as shown in FIG. 6, roller 40 may comprise two kick sections 44 disposed on opposing sides of the roller 40, where the kick surfaces 48 of each kick section 44 face opposing directions. While FIG. 6 illustrates two kick sections 44 generally separated by 180°, those skilled in the art will appreciate that these kick sections may be disposed anywhere around roller 40. Further, those skilled in the art will appreciate that roller 40 is not limited to the two illustrated kick sections 44.

Figure 7:
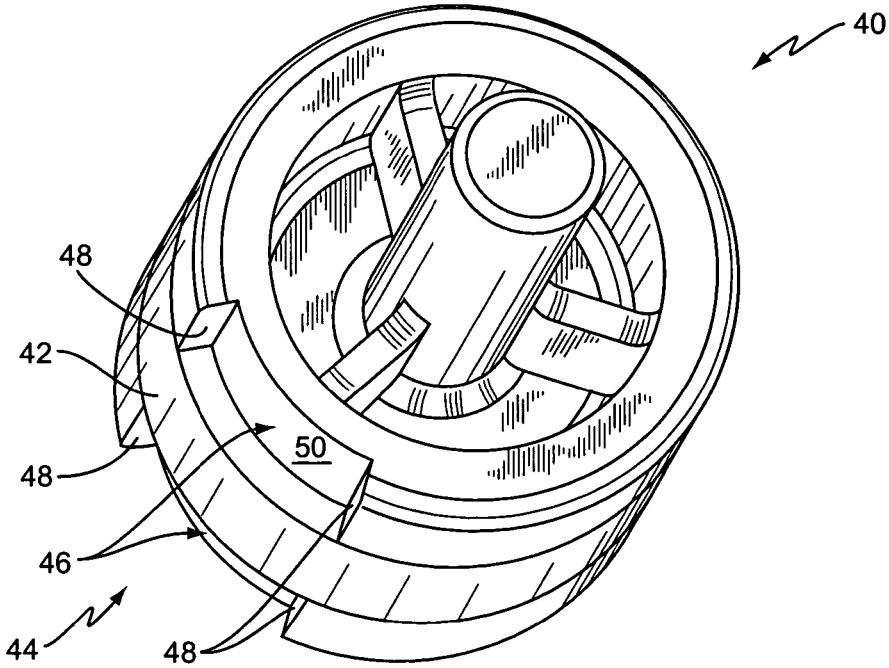
FIG. 7 is a perspective of another exemplary roller according to one exemplary embodiment of the present invention.

According to yet another exemplary embodiment, roller 40 may comprise a single dual-direction kick section 44 as shown in FIG. 7. In this embodiment, one end of the recessed area 46 includes a kick surface 48 that faces another kick surface 48 disposed on the opposing end of the recessed area 46. The opposing kick surfaces 48 may have the same or different angles. Further, the radius of the bottom surface 50 of the recessed area may stay constant along the kick section 44 such that the kick section 44 forms a uniform notch on at least one outer edge of the roller 40. Alternatively, the radius of the bottom surface 50 may vary. While FIG. 7 explicitly shows a kick section 44 having a generally internal contact surface 42 flanked by two uniformly notched recess areas 46, it will be appreciated that this embodiment is not limited to this implementation. For example, as with the embodiments discussed above, roller 40 may comprise a single kick section 44 having a single uniformly notched recess area 46, or roller 40 may comprise multiple kick sections 44, where each kick section 44 includes one or more uniformly notched recess areas 46.

The present invention may be carried out in other ways than those specifically set forth herein without departing from essential characteristics of the invention. Further, those skilled in the art will appreciate that roller 40 may include any of the features discussed herein without requiring all of the features of a specifically illustrated embodiment. In one embodiment, the invention is positioned on a single roller that does not include a second complementary roller (i.e., the roller does not form a nip). As a result, the present embodiments are to be considered in all respects as illustrative and not restrictive, and all changes coming within the meaning and equivalency range of the appended claims are intended to be embraced therein.

What is claimed is:

1. A roller having a roller circumference for use in an image forming apparatus, the roller comprising:

a contact surface having a first radius extending around the roller circumference;

a first recess extending along a first sector of the roller, a bottom surface of the first recess having a second radius less than the first radius, the first recess comprising a kick surface disposed at one end of the recess between the contact surface and the bottom surface of the first recess; and a second recess having a bottom surface with a third radius less than the first radius, the second recess comprising a kick surface disposed at one end of the recess between the contact surface and the bottom surface of the second recess, the second recess being spaced apart from the first recess such that a section of the contact surface is positioned between the first recess and the second recess; wherein the section of the contact surface positioned between the first recess and the second recess has a width less than a combined width of the first and the second recesses;

lines formed at the intersections of the kick surfaces of the first and second recesses and the contact surface are parallel to an axis of rotation of the roller.

2. The roller of claim 1 wherein an angle of the kick surface relative to the contact surface ranges between an acute angle and an obtuse angle.

3. The roller of claim 2 wherein the angle of the kick surface relative to the contact surface ranges between 30° and 150°.

4. The roller of claim 1 wherein each of the second radius and the third radius gradually increases from a bottom edge of the kick surface along a length of the recess.

5. A roller system for use in an image forming apparatus, the roller system comprising:

a first roller comprising:

a contact surface having a radius extending 360 degrees around the first roller;

at least one kick section comprising a portion of the first roller where a width of the contact surface is less than the first roller width, the at least one kick section positioned at an axial end of the first roller;

a recess extending inwardly from the contact surface along the kick section of the first roller;

a kick surface disposed on one end of the recess, the kick surface extending from the contact surface to a bottom surface of the recess;

a line formed at the intersection of the kick surface and the contact surface is parallel to an axis of rotation of the first roller; and a second roller with an outer surface that operatively engages the contact surface of the first roller.

6. The roller system of claim 5 wherein the contact surface covers at least an internal portion of the first roller width along the kick section of the first roller.

7. The roller system of claim 6 wherein the internal portion of the first roller width comprises a central portion of the first roller width.

8. The roller system of claim 5 wherein the recess comprises a first recess and a second recess, the second recess spaced from the first recess.

9. The roller system of claim 8 wherein the contact surface is positioned between the first and second recesses along the kick section of the first roller.

10. The roller system of claim 8 wherein the first recess is disposed along a first sector of the first roller and the second recess is disposed along a second sector of the first roller opposite the first sector.

11. The roller system of claim 5 wherein a radius associated with the bottom surface of the recess gradually increases between a bottom edge of the kick surface and an end of the recess opposite the kick surface.

12. The roller system of claim 5 wherein an end of the recess opposite the kick surface comprises a second kick surface extending from the contact surface to the bottom surface of the recess.

13. The roller system of claim 5 wherein the kick surface is generally perpendicular to the contact surface at the edge of the recess.

14. A roller system for moving media through an image forming apparatus, the roller system comprising:

a first roller including first and second axial ends, comprising:

a contact surface extending around the roller circumference, the contact surface having a first width less than the roller width in a kick section of the roller, the contact surface being spaced away from the first and second axial ends; and a first recess extending inwardly from the contact surface along the kick section of the roller, the first recess having a second width less than the roller width;

a line formed at the intersection of the kick section and the contact surface is parallel to an axis of rotation of the first roller; and a second roller comprising:

an outer surface that operatively engages the contact surface of the first roller.

15. The roller system of claim 14 further comprising a second recess extending inwardly from the contact surface along the kick section of the first roller, the second recess having a third width less than the first roller width.

16. The roller system of claim 15 wherein the contact surface is positioned between the first and second recesses along the kick section of the first roller.

17. The roller system of claim 14 wherein the contact surface has a second width equal to the first roller width outside of the kick section.

18. A roller system for moving media through an image forming apparatus comprising:

a first roller comprising:

a contact section having a first radius extending around a roller circumference of the first roller; and a recess extending inwardly from the contact surface along a sector of the roller circumference, a bottom surface of the recess having a second radius less than the first radius, the recess including a generally flat kick surface extending from the contact surface to the bottom surface;

a line formed at the intersection of the kick surface and the contact surface is parallel to an axis of rotation of the first roller; and a second roller comprising:

an outer diameter that forms a media-moving nip with the contact surface of the first roller, wherein the media moves through the image forming apparatus by moving through the media-moving nip.

* * * * *